United States Patent [19]

Gullickson

[11] Patent Number: 4,599,874

[45] Date of Patent: Jul. 15, 1986

[54] DECORATIVE EAR CUFF

[76] Inventor: Kathryn A. Gullickson, 6121 White Oak Ave., Reseda, Calif. 91335

[21] Appl. No.: 675,742

[22] Filed: Nov. 28, 1984

Related U.S. Application Data

[63] Continuation-in-part of Ser. No. 566,317, Dec. 28, 1983, abandoned.

[51] Int. Cl.[4] ..... A44C 7/00

[52] U.S. Cl. ..... 63/14 R; 63/14 G

[58] Field of Search ..... 63/14 R, 14 A, 14 G, 63/13

[56] References Cited

U.S. PATENT DOCUMENTS

| | | | |
|---|---|---|---|
| 1,344,556 | 6/1920 | Moler | 63/14 A |
| 2,414,382 | 1/1947 | McCann | 63/14 |
| 2,498,748 | 2/1950 | Barron | 63/14 |
| 2,511,170 | 6/1950 | McCann | 63/14 A |
| 2,556,654 | 6/1951 | Kulak | 63/14 |
| 3,459,007 | 8/1969 | Whatley | 63/14 |
| 4,187,838 | 2/1980 | Dubrowski | 63/14 R |

FOREIGN PATENT DOCUMENTS

| | | | |
|---|---|---|---|
| 618528 | 9/1935 | Fed. Rep. of Germany | 63/14 A |
| 792326 | 10/1935 | France | 63/14 A |
| 899819 | 6/1962 | United Kingdom | 63/14 G |

OTHER PUBLICATIONS

Reo-Advertisement on lower left of p. 34 of *Fashion Accessories* Magazine, Oct., 1981.

*Primary Examiner*—F. Barry Shay
*Attorney, Agent, or Firm*—Merrill N. Johnson

[57] ABSTRACT

An ear cuff is disclosed herein of one-piece unitary construction from a thin flat elongated strip of metal formed into a pair of clips separated in spaced-apart relationship and each clip adapted to engage in partial encirclement with the inner and outer natural ridges of the ear of a wearer for support and retention without deformation of the flesh of the ear. The upper clip is rigid and non-pliable while the lower clip is deformable by thumb to finger pressure to fit and conform to the shape and contour of the ear ridge it encircles and engages. A decorative item may be included as part of the ear cuff or attached thereto by welding or a ring or a clip.

9 Claims, 11 Drawing Figures

FIG. 1
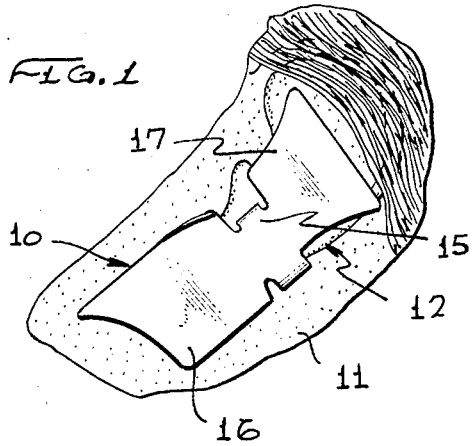
FIG. 2
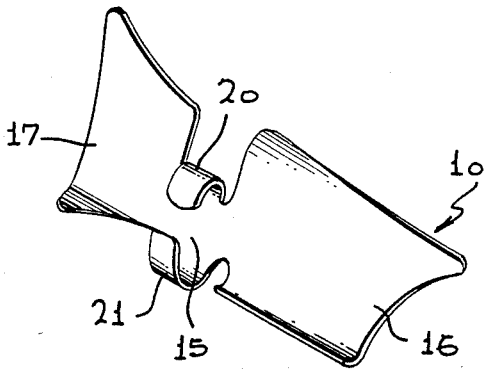
FIG. 4
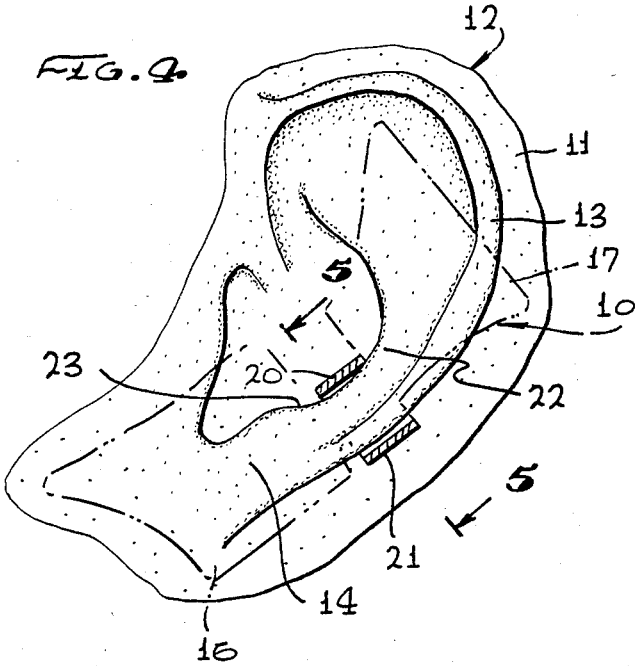
FIG. 3
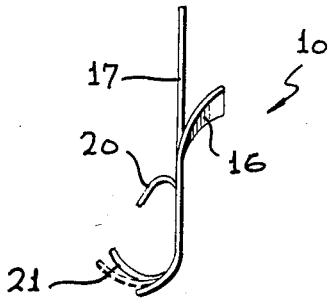
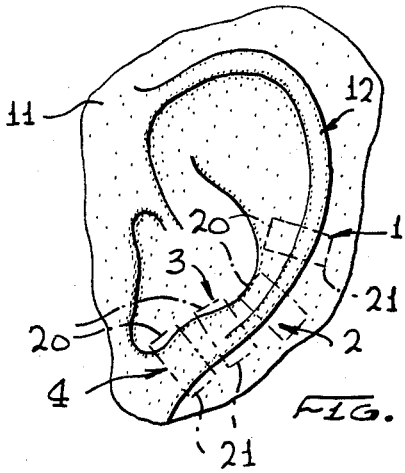
FIG. 6
FIG. 5
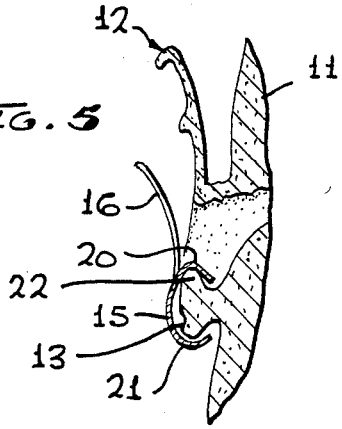

DECORATIVE EAR CUFF

This application is a continuation-in-part of my copending prior application Ser. No. 566,317 filed Dec. 28, 1983, and now abandoned.

BACKGROUND OF THE INVENTION

1. Field of the Invention

This invention relates to ear ornaments or decorations and more particularly to a novel decorative ear cuff which is totally supported on the ridges of the ear of the wearer.

2. Brief Description of the Prior Art

In the past, it has been the conventional practice for women, and to a lesser extent men, to decorate their ears by employing a variety of earrings. One common type of earring requires a screw on the earring itself to be turned so as to bear against the ear lobe of the wearer until the earring is self-supporting from the ear lobe. Problems have been encountered with this type of earring inasmuch as the pressure exerted by the turned screw is somewhat painful and blood circulation to the ear in the vicinity of the earring is greatly impaired.

Another conventional method of decorating an ear resides in surgically piercing the ear wherein an aperture is formed in the ear lobe and a pin is inserted therethrough from which the decorative earring is supported. Again, this may be painful to the wearer and unless the aperture is maintained open, growth will occur which will close the aperture. Also, some persons are allergic to the initial piercing of the ear.

Still further decorative ear devices have been employed in the form of ear loops comprising a shaped wire adapted to hang from the top of the ear adjacent to the head downwardly behind the ear. In most instances, decorative beads or baubles dangle from the ends of the wire so as to show in front of the ear and at the lower or lobe portion of the ear. Such devices are usually large and do not conform to the contour of the wearer's ear shape or head contour.

The aforementioned procedures for decoration of an ear have been unacceptable to a large number of persons. Therefore, a long-standing need has existed to provide a novel ear decoration in the form of a clip or cuff or the like which may be supported on the structure of the ear without causing pain or deformation of the flesh of the ear and without the necessity of a surgical procedure.

Various proposals to meet this long-standing need have been suggested as shown in U.S. Pat. Nos. 2,414,382 and 2,511,170 and British Pat. No. 899,819. However, the proposed devices shown in the two U.S. patents are relatively complicated and expensive to manufacture and the devices shown in the British patent are not adjustable to fit the varying forms of wearers' ears. Hence, so far as I am aware, none of these devices has met with great wearer acceptance.

SUMMARY OF THE INVENTION

Accordingly, the above problems and difficulties are obviated by the present invention which provides a unique decorative ear device having a thin flat elongated body portion formed with an upper and a lower arcuate clip adapted to cooperate with each other for comfortable attachment onto the ridges of the ear of the wearer without deformation of the flesh of the ear. The lower arcuate clip is so constructed that it is deformable by thumb to finger pressure to fit the lower arcuate clip over the outer ridge of the wearer's ear. A decorative item may be included as part of the device or attached thereto by welding or by a ring or clip or other suitable means.

Therefore, it is among the primary objects of the present invention to provide a novel decorative device for the ear which permits decorative items to be comfortably suspended from in front of the ear and on the ridge of the ear.

Another object of the present invention is to provide a novel ear cuff for decorating the wearer's ear which is totally supported on the ridges of the ear without deforming the flesh of the ear.

Yet another object of the present invention is to provide a novel ear cuff made from a thin, flat elongated strip of metal which is substantially C-shaped and one end portion of which is deformable by thumb to finger pressure to fit the end portion of the strip comfortably over the outer ridge of the ear.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description of the preferred embodiments, taken in connection with the accompanying drawings, in which:

FIG. 1 is a front elevational view showing one form of my novel decorative ear cuff carried on the ear of a wearer.

FIG. 2 is a perspective view of the decorative ear cuff shown in FIG. 1.

FIG. 3 is an end elevational view of the novel decorative ear cuff shown in FIGS. 1 and 2 illustrating the deformation of the lower arcuate clip.

FIG. 4 is a view similar to FIG. 1 showing in broken lines the preferred position of the decorative ear cuff mounted on the natural ridges of the wearer's ear.

FIG. 5 is a transverse cross-sectional view of the ear cuff shown in FIG. 4 taken in the direction of arrows 5—5.

FIG. 6 is a diagrammatic illustration showing the progressive engagement and retention of the ear clips onto the ear ridges of the wearer as the device is being mounted onto the wearer's ear.

DESCRIPTION OF THE PREFERRED EMBODIMENTS

Figure 7:
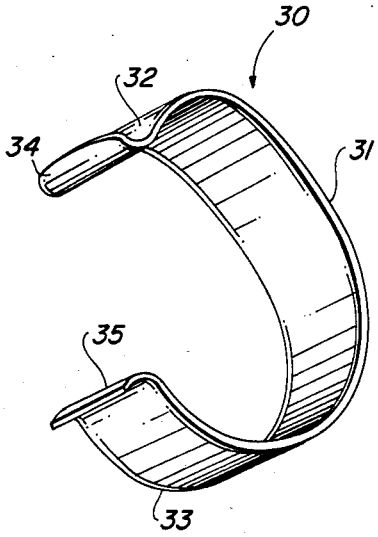
FIG. 7 is a perspective view showing a second form of my novel decorative ear cuff.

Referring first to FIG. 1, one form of my novel ear cuff 10 is illustrated in position on the ear of a wearer. The person's head is indicated by numeral 11 and the ear, broadly indicated by numeral 12, includes an outer edge marginal ridge circumscribing the entire top and middle portion of the ear running from the top to a lobe at the bottom of the ear.

The novel ear cuff 10 includes a central or main body portion 15 having opposite ends which support a pair of decorative items identified by numerals 16 and 17 respectively. The decorative items may take any particular form; however, in the present embodiment the decorative items are integrally formed with the central body portion 15 of cuff 10 so that the ear cuff is of unitary construction and composed of a single or one-piece structure. Preferably, the decorative items 16 and 17 are of a solid mass and curved or shaped to a desired geometric configuration which constitutes the decorative feature of the ear cuff. Also, the central body portion 15 is reduced in thickness as compared to the thickness of the decorative elements 16 and 17 so that the overall one-piece construction has a narrow mid-section. The mid-section or central body portion 15 includes retaining means for supporting the decorative cuff onto the ear of the wearer in the form of clips 20 and 21 that cooperate with each other to support and retain the cuff onto the ear.

Referring now to FIG. 2, it can be seen that the clips 20 and 21 are arcuate and face each other so as to provide a pair of receptacles for receiving natural ridges formed on the ear 12. It is to be understood that the uppermost or top clip 20 is pre-positioned in the desired relation to central or main body portion 15 when the cuff is being manufactured and is intended to be rigid and that the lower clip 21 is pliable in the sense that clip 21 may be manually deformed by the thumb and fingers of the wearer to form fit or conform to the shape of the outer ear ridge. Also, it is to be noted in FIG. 2 that decorative items 16 and 17 are curved and shaped to provide a desired decorative effect.

Referring now to FIG. 3, it can be seen that the clip 21 is intended to be deformable inasmuch as an outer position is shown in broken lines and an inner position is shown in solid lines which represents a position forced by the fingers of the wearer against ear ridge 13. Also, it is to be noted that upper clip 20 constitutes a hook in transverse elevational view which with respect to the flat central body portion or mid-section 15 provides a U-shaped receptacle having an opening so that the extreme end of the clip does not gouge or press into the flesh of the ear. While the opening beneath upper clip 20 is intended to be fixed, the lower hook 21 is intended to be adjustable and hence made of deformable material.

Referring now to FIG. 4, it can be seen that the ear 12 not only includes an outer peripheral ridge 13 but an inner ridge 22 which is in fixed spaced apart relationship with outer ridge 13. Also, it can be seen that the receptacles formed by clips 20 and 21 are occupied by inner and outer ridges 22 and 13 respectively so that the ear cuff is securely supported on the ear. The clips 20 and 21 are slidably engaged with the ridges 22 and 13 and the ear cuff is slid downwardly until the top clip 20 reaches a node 23 adjacent to ear lobe 14. At this time, the ear cuff movement into its retention position will stop. In a sense, the ridges 22 and 13 provide tracks on which the clips serving as guides will travel from the top of the ear towards the bottom of the ear with the clip 21 serving as an initial guide during the movement and with the clip 20 engaging with inner ridge 22 half way through the movement and terminating the movement when clip 20 reaches ear node 23.

This latter relationship is shown more clearly in FIGS. 5 and 6 wherein it can be seen that the clips 20 and 21 ride on the ridges 22 and 13 respectively and that there is progressive downward movement of the clips during installation. The relative positions are shown by numerals 1, 2, 3, and 4 in FIG. 6 starting with initial position 1 in which the clip 21 engages outer ridge 13 and terminating with engagement of clip 20 with ear node 23. Because of the unique natural construction of the ear, clip 20 will not engage with inner ridge 22 until midway through the cuff's travel from position 1 to position 3.

Figure 8:
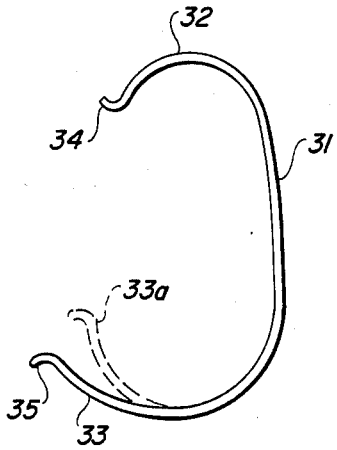
FIG. 8 is a side view of the form of ear cuff shown in FIG. 7.

Referring next to FIGS. 7 and 8, a second preferred form of my novel ear cuff 30 is formed from a thin flat elongated strip of metal known as soft tempered cartridge brass, an alloy consisting of 70% copper and 30% zinc. Preferably the brass strip has a thickness of approximately 0.012 inches and a width of 0.25 inches. In order to provide an attractive decorative finish the strip may be plated with gold, silver or chromium.

The thin flat metal strip from which cuff 30 is formed is approximately $1\frac{3}{8}$ inches in length. Its originally square ends are rounded off and the strip formed into the unique C-shaped configuration shown in FIGS. 7 and 8. As such, ear cuff 30 includes a central body portion or mid-section 31 and a rigid upper arcuate clip 32 terminating in rounded end 34 and a deformable lower arcuate clip 33 terminating in rounded end 35.

The distance between the end of upper clip 32 and the end of lower clip 33 is critical and always at least $\frac{1}{4}$ of an inch to facilitate installation of the cuff into the ridges of the ear without pain or deformation of the flesh of the ear.

To facilitate installation of cuff 30 onto the ridges of the ear without pressure or deformation of the flesh of the ear, the rounded ends 34 and 35 of the cuff are smoothly curved away from the opening between clips 32 and 33 as best shown in side view FIG. 8. The deformability of lower clip 33 is illustrated in FIG. 8 by the dotted lines 33*a*.

The outer surface of the cuff's mid-section 31, especially when brightly plated with gold or chromium, can itself provide the decorative portion of the ear device. Or cuff 30 can be enhanced by a separate decorative item such as a jewel or coin attached to the cuff by welding or a ring or clip or other suitable connector.

Figure 9:
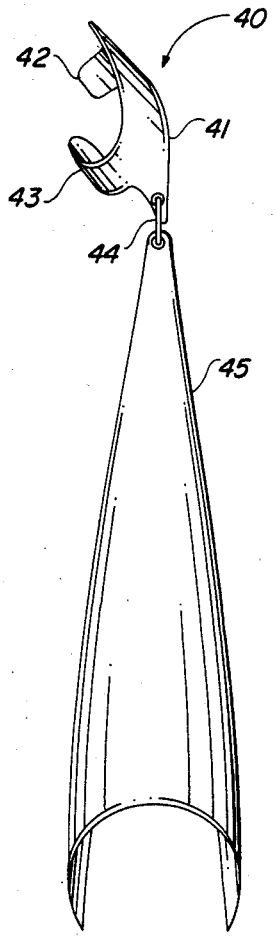
FIG. 9 is a front elevational view showing a third form of my novel decorative ear cuff.
Figure 10:
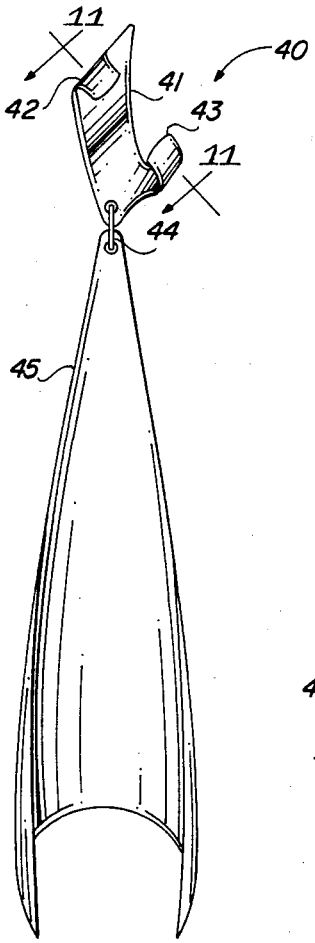
FIG. 10 is a rear elevational view of the form of ear cuff shown in FIG. 9.
Figure 11:
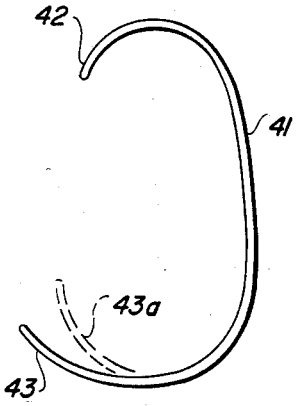
FIG. 11 is a transverse cross-sectional view of the ear cuff shown in FIGS. 9 and 10 taken in the direction of arrows 11—11 of FIG. 10 showing the deformation of the lower arcuate clip.

Referring finally to FIGS. 9, 10 and 11, a third preferred form of my novel ear cuff 40 is formed from a thin flat elongated strip of metal approximately $1\frac{3}{8}$ inches long. As with the strip used to form cuff 30, the strip may be brightly plated with gold, silver or chromium and then formed into an ear cuff 40 having the configuration shown in FIGS. 9–11.

Cuff 40 includes a generally flat rhomboid shaped central body portion 41 and a pair of clips 42 and 43 each having rounded ends. The distance between the ends of clips 42 and 43 is at least $\frac{1}{4}$ of an inch. Upper clip 42 is arcuate and forms a U-shaped recess or opening adapted to fit over the inner ridge of an ear. Lower clip 43 is also arcuate but with a wider opening than clip 42.

Both of the ends of clips 42 and 43 are smoothly rounded as best shown in FIG. 10 to facilitate mounting onto the ridges of the ear without deformation of the flesh of the ear. Lower clip 43 is flexible to permit it being custom fitted over the outer ridge 13 of the wearer's ear. This fitting of clip 43 is illustrated by dotted lines 43*a* in FIG. 11.

The lowermost corner of the cuff's rhomboid shaped central body portion 41 contains a circular hole which receives a ring 44 supporting a decorative pendant 45 or other decorative item as desired.

Therefore, it can be seen that my novel ear cuff provides a unique ear decoration in a wide variety of forms. Unlike conventional clip-on or pierce-ear wear, the present invention adorns the ear and is held securely in place by a small flexible lower clip cooperating with a rigid upper clip. The ear cuff is feather-light and allows itself to be molded to the contours of the individual ear due to the deformability of the material used. The ear cuff is specifically designed for comfortable extended wear and will be hardly felt by the wearer when properly fitted. Fitting the ear cuff requires a gentle touch and a little patience, but once the custom fit is obtained, no further adjusting should ever be necessary. Adjustment is achieved solely by gently bending the lower cuff clip.

To place the ear cuff onto the ear, the wearer starts at the upper curve of the ear by placing the cuff around the outer ear ridge 13 so that both of the cuff's clips serve as a guide as the cuff is moved downwardly. The wearer next slides the cuff downwardly along the outer ridge 13, slightly twisting inwardly so that the upper clip encircles the inner ear ridge 22 while the lower clip maintains contact with the outer ridge 13. The cuff finally rests at mid-ear position (position 3 in FIG. 6) when the upper clip rests against the node 23 of the ear 12 or may be slid further down to encircle ear lobe 14 (position 4 in FIG. 6).

While three preferred embodiments of the present invention have been shown and described, it will obvious to those skilled in the art that changes and modifications may be made without departing from this invention in its broader aspects and, therefore, the aim in the appended claims is to cover all such changes and modifications as fall within the true spirit and scope of my invention.

I claim:

1. A decorative ear cuff for releasable attachment to the inner and outer ridges of an ear of a wearer comprising a thin, flat, one-piece elongated strip of metal formed into a flat main body portion and an upper arcutate clip and a lower arcuate clip, said clips forming means adapted to cooperate with each other for fitting the cuff to an individual ear and for comfortable attachment of the cuff onto the inner and outer ridges of the ear of the wearer without deformation of the flesh of the ear, said upper clip being permanently prepositioned with respect to said main body portion and said lower clip being manually deformable relative to said main body portion whereby it may be adjusted by the wearer to a position suited to the wearer's ear.

2. A decorative ear cuff as defined in claim 1 wherein a decorative item is attached to the main body portion of said cuff.

3. A decorative ear cuff as defined in claim 1 wherein the elongated strip of metal has a thickness of 0.012 inches and the upper and lower clips have a width of approximately $\frac{1}{4}$ of an inch.

4. A decorative ear cuff for attachment to the inner and outer ridges of an ear formed from a one-piece, thin, flat, elongated strip of metal comprising a generally flat main body portion, a rigid elongated arcuate upper clip, and an elongated arcuate lower clip, said clips forming means adapted to cooperate with each other for fitting the cup to an individual ear and for comfortable attachment of the cuff onto the inner and outer ridges of the ear of the wearer without deformation of the flesh of the ear, said upper clip being permanently prepositioned with respect to said main body portion and said lower clip being manually deformable relative to said main body portion whereby it may be adjusted by the wearer to a position suited to the wearer's ear.

5. A decorative ear cuff as defined in claim 4 wherein the strip of metal forming the cuff is an alloy consisting of 70% copper and 30% zinc and has a thickness of 0.012 inches.

6. A decorative ear cuff as defined in claim 4 wherein the strip of metal forming the cuff has a length of approximately $1\frac{3}{8}$ inches and the distance between the ends of the upper and lower clips is at least $\frac{1}{4}$ of an inch.

7. A decorative ear cuff for releasable attachment to the inner and outer ridges of an ear of a wearer comprising a thin, flat, one-piece, elongated strip of metal having a generally flat main body portion and upper and lower arcuate clips, said clips forming means adapted to cooperate with each other for fitting the cuff to an individual wearer and for comfortable attachment of the upper and lower clips onto the inner and outer ridges respectively of the ear of the wearer without deformation of the flesh of the ear, said upper clip being permanently pre-positioned with respect to said main body portion and said lower clip being manually deformable relative to said main body portion whereby it may be adjusted to a position suited to the wearer's ear, said upper and lower arcuate clips having rounded ends and a width of about $\frac{1}{4}$ of an inch and a space between the ends of said clips of at least $\frac{1}{4}$ of an inch.

8. A decorative ear cuff as defined in claim 7 wherein the elongated strip of metal is an alloy consisting of 70% copper and 30% zinc.

9. A decorative ear cuff as defined in claim 7 wherein the elongated strip of metal has a thickness of approximately 0.012 inches and a length of approximately $1\frac{3}{8}$ inches.

* * * * *